US005131630A

United States Patent [19]

Nash

[11] Patent Number: 5,131,630

[45] Date of Patent: Jul. 21, 1992

[54] DRIFT FENCE

[76] Inventor: Merle W. Nash, P.O. Box 644, Pooler, Ga. 31322

[21] Appl. No.: 761,302

[22] Filed: Sep. 17, 1991

[51] Int. Cl.[5] ..... E01F 7/02

[52] U.S. Cl. ..... 256/12.5; 256/23; 256/34

[58] Field of Search ..... 256/12.5, 13, 34, 23, 256/62

[56] References Cited

U.S. PATENT DOCUMENTS

| | | | |
|---|---|---|---|
| 175,857 | 4/1876 | Dreher | 256/34 X |
| 283,606 | 8/1883 | Hollister | 256/34 |
| 328,392 | 10/1885 | Dudley | 256/34 X |
| 4,200,260 | 4/1980 | Dailey | 256/24 |
| 4,774,792 | 10/1988 | Ballance | 403/191 X |

FOREIGN PATENT DOCUMENTS

| | | | |
|---|---|---|---|
| 18456 | of 1909 | United Kingdom | 256/34 |

*Primary Examiner*—Andrew V. Kundrat

*Attorney, Agent, or Firm*—John B. Dickman, III

[57] ABSTRACT

A drift fence for retaining drifting snow and sand, and to be used as a barrier for people and animal control is disclosed. The drift fence is provided with tubular slats held together by parallel cords or cables and spaced apart by a plurality of retainers. Each retainer has an H-shape to receive tubular slats between the parallel legs and is held to the slats by the parallel cord or cables.

6 Claims, 1 Drawing Sheet

DRIFT FENCE

BACKGROUND OF THE INVENTION

This invention relates to a drift fence for holding back snow, sand, etc., and in particular to a drift fence for serpentine configurations and undulating surfaces.

Drift fences have been in use for many ears as portable fences in retaining sand and preventing wind and water erosion, and for retaining snow from drifting by the force of the winds. In addition, the use of drift fences has also been utilized in many other ways as containment for animals, other livestock, and as holding bins for corn and other agricultural products. It is sometimes necessary to use temporary fencing as barriers for safety in construction excavation sites and controlling people at sporting events and parades, as well as many other uses.

In the past, drift fences have been made of wooden slats held together by wire. The fencing could be rolled up into a cylindrical package for ease of handling and transporting. U.S. Pat. No. 283,606, issued to Hollister, is a variation of the wooden slat fence held together by wire. The Hollister fence uses wooden slats and wire with washers as spacers between the slats. Another patent of interest even though it does not pertain to fencing. is U.S. Pat. No. 175,857, issued to Dreher. In the Dreher patent a mat or screen is constructed of a plurality of slats separated by balls. The slats and balls are held together by a cord, which is threaded through holes in the slats and balls.

Other patents of similar interest include U.S. Pat. No. 4,200,260, issued to Dailey et al and U.S. Pat. No. 4,774,792, issued to Ballance. Dailey et al discloses a picket fence where the pickets have key slots and keys, such as rods or dowels to hold the pickets together. In Ballance there are clips to join a frame-to-frame structure together.

The subject matter of the cited patents is of general interest to the present invention; however, they do not suggest a drift fence similar to the invention.

SUMMARY OF THE INVENTION

The present invention provides a rugged and reliable drift fence for controlling drifting snow or sand, or for confining people or crops to certain areas. Briefly, the invention includes slats or pickets cut from PVC tubing and held together with a cord or cable. Spaced between the plastic slats are retainers made of an elastic material. The retainers have a generally H-shaped cross section forming two connection joints to receive and separate the slats. The cord or cable is passed through a hole in the PVC tubing slat and then through a hole in the retainer. This procedure is continued until the necessary length fencing is manufactured. There are two or more retainers separating the slats, depending on the length of the slats.

It is a primary object of the present invention to provide a drift fence that is easy to assemble and inexpensive to manufacture.

Still a further object of the present invention is to provide a drift fence that is safer to use around ski areas and any place where people and animal may come in contact with the fencing.

Yet another object of the present invention is to provide a drift fence that is easy to install on all types of terrain and to roll up and store.

DESCRIPTION OF THE INVENTION

Figure 1:
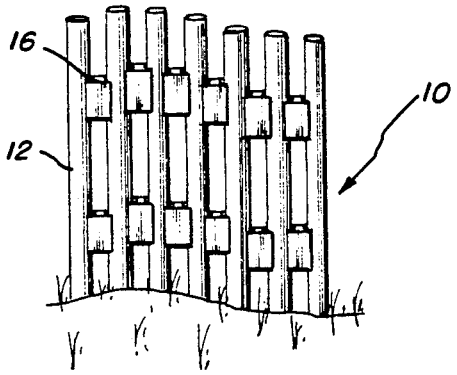
FIG. 1 is a perspective view of a drift fence of the present invention.
Figure 2:
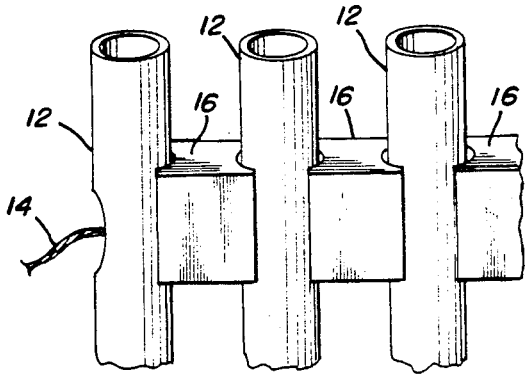
FIG. 2 is another perspective view of a drift fence of the present invention.

Referring to the drawings of FIGS. 1–6, there is shown a drift fence 10 of the present invention. Drift fence 10 is used as a barrier or containment on ski slopes or dunes at the ocean. The fence 10 is constructed of plastic, for example polyvinylchoride, known as PVC. Show in FIGS. 1 and 2 are PVC pockets or slats 12 held together by a cord or cable 14 payed through a hole or aperture 13 in the slats FIGS. 2 and 3. Because the slats 12 are made of PVC, and in particular PVC tubing, the slats are less likely to break than the wooden slats; therefore, the PVC slats are safer around ski areas and anywhere people are present. In addition, PVC slats will flex a lot more than wooden slats and are not affected by weather.

Figure 3:
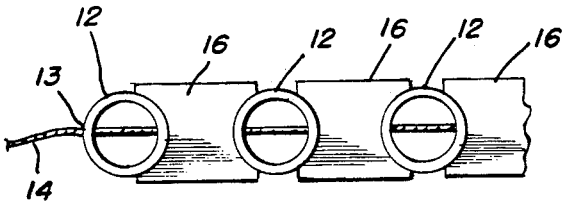
FIG. 3 is a top plan view of a retainer of the present invention.
Figure 4:
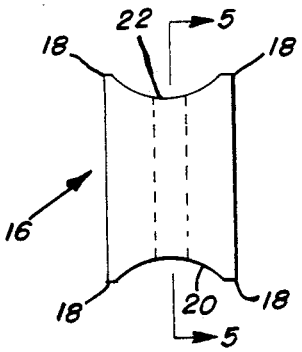
Figure 5:
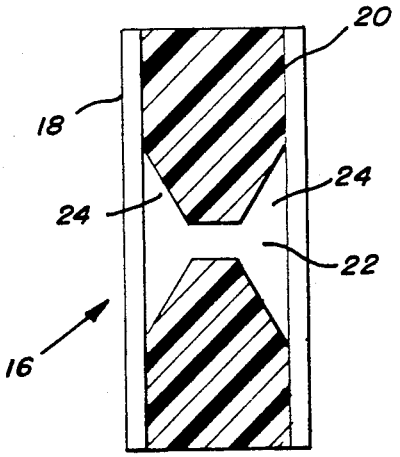
FIG. 5 is a cross-sectional view taken along the line 5—5 of FIG. 4.

FIGS. 2 and 3 show slats 12 separated by retainers 16. Each has an H-shaped cross-section. FIGS. 3 and 4 to partially receive the tubular shape of a slat 12 between the parallel vertical lets 18 and intermediate cross member 20 of the retainer 16. There is a hole or aperture 22 extending through the cross member 20, whereby cord or cable 14 is strung through the slats 12 and retainers 16 and drawn tight to provide a stable fencing.

Retainer 16 is shown in FIG. 4 to have parallel vertical legs 18 and an intermediate cross ember 20. The depressions in cross member 20 receive the tubular shape of a slat 12 and is concave to mate with the cylindrical surface of the slat.

Figure 6:
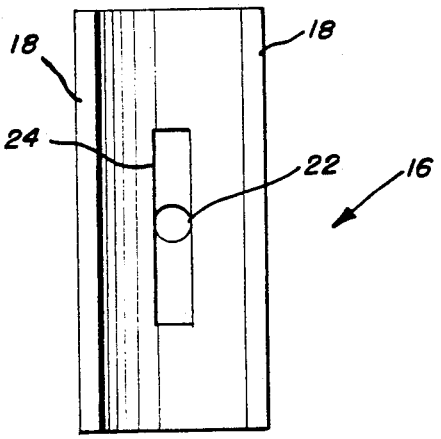
FIG. 6 is a front plan view of a retainer of the present invention.

A cross-section of the retainer 16 is shown in FIG.. 5. Since the fence 10 can be installed on uneven terrain, some slats 12 may be higher or lower in relation to the adjacent slats. To accommodate the raising or lowering of the slats 12, the aperture 22 in he retainer 16 is flared at 24 to prove for the adjustment. The cord or cable 14 can be directed up or down according to the position of the slat 12 and its aperture 13. FIG. 6 shows flare 24 from one end.

The retainer 16 is molded of an elastic material such as rubber or a plastic. Using an elastic material provides the retainer with a flexibility to permit it to bend to make curves in the fencing 20, or to roll it into cylinders for hauling or storage. According to the length of the slats 12 two or more retainers will be used.

It will, of course, be understood that various changes may be made to the form, details, arrangement and structure of the various parts without departing from the scope of the invention.

I claim:

1. A drift fence for preventing snow or sand from drifting, comprising:

a plurality of vertical slat members having a plurality of apertures therethrough;

at least two parallel cords connecting said plurality of vertical slat members together, where said cords are payed through said apertures; and a plurality of retainer means separating said slat members and partially encompassing adjacent parallel vertical slat members, and where said retainer means having apertures through which said cords are payed and drawn tight to provide a stable fencing.

2. A drift fence as in claim 1, wherein said retainer means are H-shaped and have a pair of parallel legs and an intermediate cross member forming a pair of connection joints to receive and separate said slats.

3. A drift fence as in claim 2 wherein said slat members are tubular in shape.

4. A drift fence as in claim 3 wherein said tubular slat members are flexible.

5. A drift fence as in claim 4 wherein said retainer means formed by said parallel legs and said intermediate cross member have concave areas to receive and mate with said tubular slat members.

6. A drift fence as in claim 5 wherein said retainer means have apertures are flared on either end of said apertures to provide vertical adjustment of said slat members.

* * * * *